US011132958B2

(12) United States Patent
Lee et al.

(10) Patent No.: US 11,132,958 B2
(45) Date of Patent: Sep. 28, 2021

(54) DISPLAY APPARATUS AND CONTROL METHOD THEREOF

(71) Applicant: SAMSUNG ELECTRONICS CO., LTD., Suwon-si (KR)

(72) Inventors: Sang-hoon Lee, Suwon-si (KR); Jeong-il Kang, Yongin-si (KR)

(73) Assignee: SAMSUNG ELECTRONICS CO., LTD., Suwon (KR)

( * ) Notice: Subject to any disclaimer, the term of this patent is extended or adjusted under 35 U.S.C. 154(b) by 21 days.

(21) Appl. No.: 16/046,302

(22) Filed: Jul. 26, 2018

(65) Prior Publication Data

US 2019/0228718 A1 Jul. 25, 2019

Related U.S. Application Data

(60) Provisional application No. 62/621,808, filed on Jan. 25, 2018.

(30) Foreign Application Priority Data

Apr. 10, 2018 (KR) ..... 10-2018-0041778

(51) Int. Cl.
*G09G 3/34* (2006.01)
*G09G 3/20* (2006.01)

(52) U.S. Cl.
CPC ..... *G09G 3/3406* (2013.01); *G09G 3/2018* (2013.01); *G09G 2320/064* (2013.01); *G09G 2320/0646* (2013.01); *G09G 2330/02* (2013.01); *G09G 2330/045* (2013.01); *G09G 2360/16* (2013.01)

(58) Field of Classification Search
CPC ..... G09G 3/3406; G09G 3/2018; G09G 2320/064; G09G 2320/0646
See application file for complete search history.

(56) References Cited

U.S. PATENT DOCUMENTS 6,400,418 B1 6/2002 Wakabayashi
8,487,550 B2 7/2013 Zhang et al.
(Continued)

FOREIGN PATENT DOCUMENTS

JP 2001-356748 A 12/2001
KR 10-1635220 B1 7/2016
KR 10-2017-0035111 A 3/2017

*Primary Examiner* — Patrick N Edouard
*Assistant Examiner* — Eboni N Giles
(74) *Attorney, Agent, or Firm* — Sughrue Mion, PLLC

(57) ABSTRACT

A display apparatus is provided. The display apparatus includes: a display panel; a backlight unit configured to provide light to the display panel; a signal processor configured to obtain a PWM signal corresponding to a grayscale of an input image; and a driver including a switching element, the driver being configured to control a current applied to the backlight unit by alternately turning the switching element on/off during a section in which the PWM signal provided from the signal processor is in an on-state, and the driver is configured to, based on the grayscale of the input image being greater than or equal to a threshold value, alternately turn the switching element on/off based on a first period, and, based on the grayscale of the input image being less than the threshold value, to alternately turn the switching element on-off based on a second period shorter than the first period.

12 Claims, 14 Drawing Sheets

(56) References Cited

U.S. PATENT DOCUMENTS

| | | | | |
|---|---|---|---|---|
| 2012/0217889 | A1* | 8/2012 | Jayabalan | H05B 45/3725 315/209 R |
| 2016/0049877 | A1 | 2/2016 | Kang et al. | |
| 2016/0189636 | A1* | 6/2016 | Liu | G09G 3/3426 345/690 |
| 2017/0229072 | A1* | 8/2017 | Xing | G09G 3/3406 |
| 2018/0120642 | A1* | 5/2018 | Zhang | G02F 1/133611 |
| 2018/0144676 | A1* | 5/2018 | Nadershahi | G09G 3/2055 |
| 2018/0180941 | A1* | 6/2018 | Zhang | G02F 1/133602 |

* cited by examiner

DISPLAY APPARATUS AND CONTROL METHOD THEREOF

CROSS-REFERENCE TO RELATED APPLICATIONS

This application is based on and claims priority under 35 U.S.C. § 119 from U.S. Provisional Application No. 62/621,808, filed on Jan. 25, 2018, in the United States Patent and Trademark Office, and Korean Patent Application No. 10-2018-0041778, filed on Apr. 10, 2018, in the Korean Intellectual Property Office, the disclosures of which are incorporated herein by reference in their entireties.

BACKGROUND

1. Field

The disclosure relates to a display apparatus, and more particularly, to controlling a switching element which allows a current, applied to a backlight unit providing light to a display panel, to rise and fall.

2. Description of Related Art

A display apparatus which uses a backlight unit, including a light emitting element (light emitting diode (LED)), as a light source, requires a driving unit to apply a current to the LED light source to drive the LED light source.

A related-art driving unit controls a current to be applied to a light emitting element according to a duty of a pulse width modulation (PWM) signal and a size of a dimming signal.

In addition, the related-art driving unit supplies a current of a relatively constant size to the light emitting element by turning on/off a switching element, such as a dimming FET, during a duty section in which a PWM signal is inputted.

FIG. 1 illustrates an example of a related-art driving unit 10 configured as a circuit.

Referring to FIG. 1, the related-art driving unit 10 includes an input voltage $V_{DRIVE}$, an inductor L, a dimming FET corresponding to a switching element, an output capacitor C, and an integrated circuit (IC) for controlling a current applied to each of light emitting elements 20 included in a backlight unit.

Referring to FIG. 1, when the dimming FET is turned on, a current flows through the input voltage $V_{DRIVE}$, the light emitting element 20, the inductor L, and the dimming FET, and a current at the inductor L and the light emitting unit 20 rises.

In addition, when the dimming FET is turned off, a current flows through the inductor L, the diode, and the light emitting element 20, and a current at the inductor L and the light emitting element 20 falls.

However, when the related-art driving unit 10 has to control luminance of the light emitting element 20 to be relatively low, that is, when an image displayed on a display corresponds to relatively low grayscales, there is a problem that each grayscale is not linearly and precisely expressed in each level.

In particular, it is common that grayscale levels of 1024 levels (10 bits) or higher are used to express the grayscale, and, if the grayscale levels are further sub-divided, there is a problem that it is difficult to clearly identify luminance of an image with a low grayscale according to a grayscale level.

SUMMARY

Provided is a display apparatus which linearly and precisely expresses each grayscale level even for a low-grayscale image.

Also provided is a display apparatus which expresses a grayscale level more precisely than in a related-art method, without influencing a lifespan and an operation of the apparatus.

In accordance with an aspect of the disclosure, a display apparatus includes: a display panel; a backlight unit configured to provide light to the display panel; a signal processor configured to obtain a pulse width modulation (PWM) signal corresponding to a grayscale of an input image; and a driver including a switching element, the driver being configured to control a current applied to the backlight unit by alternately turning the switching element on and off during a section in which the PWM signal provided from the signal processor is in an on-state, wherein the driver is further configured to, based on the grayscale of the input image being greater than or equal to a threshold value, alternately turn the switching element on and off based on a first period, and, based on the grayscale of the input image being less than the threshold value, to alternately turn the switching element on and off based on a second period which is shorter than the first period.

The grayscale of the input image may include a first grayscale and a second grayscale which are smaller than the threshold value and are continuous among a plurality of grayscales divided according to a luminance of the input image, and wherein the driver may be further configured to alternately turn the switching element on and off at least once, in a difference section between a section in which a PWM signal corresponding to the first grayscale is in the on-state and a section in which a PWM signal corresponding to the second grayscale is in the on-state, based on the second period.

The driver may be further configured to, based on a duty cycle of the PWM signal being greater than or equal to a value, alternately turn the switching element on and off based on the first period, and, based on the duty cycle of the PWM signal being less than the value, to alternately turn the switching element on and off based on the second period.

The signal processor may be further configured to obtain a dimming signal corresponding to the grayscale of the input image, and wherein the driver may be further configured to, based on a size of the dimming signal provided from the signal processor being greater than or equal to a value, alternately turn the switching element on and off based on the first period, and, based on the size of the dimming signal being less than the value, to alternately turn the switching element on and off based on the second period.

The driver may be further configured to identify a grayscale of the input image based on a current applied to the backlight unit, and to alternately turn the switching element on and off based on a period according to the identified grayscale.

The display apparatus may further include a variable inductor connected with the backlight unit, wherein the driver may be further configured to, based on the grayscale of the input image being greater than or equal to a threshold value, set an inductance of the variable inductor to a first value, and, based on the grayscale of the input image being less than the threshold value, to set the inductance of the variable inductor to a second value which is smaller than the first value.

The driver may be further configured to, based on the grayscale of the input image being less than or equal to a first threshold value, alternately turn the switching element on and off based on a third period; based on the grayscale of the input image being greater than or equal to a second threshold value, which is greater than the first threshold value, to alternately turn the switching element on and off based on a fourth period which is longer than the third period; and based on the grayscale of the input image being greater than the first threshold value and is less than the second threshold value, to alternately turn the switching element on and off based on a fifth period, and wherein the fifth period may constantly increase from the third period to the fourth period as the grayscale of the input image increases from the first threshold value to the second threshold value.

The driver may be further configured to, based on the grayscale of the input image gradually decreasing and being lower than a first threshold value, alternately turn the switching element on and off based on a third period; and based on the grayscale of the input image gradually increasing and being higher than a second threshold value, to alternately turn the switching element on and off based on a fourth period which is longer than the third period, and wherein the first threshold value is smaller than the second threshold value.

Based on the switching element being turned on, the current applied to the backlight unit rises, and, based on the switching element being turned off, the current applied to the backlight unit falls.

In accordance with another aspect of the disclosure, there is provided a control method of a display apparatus, the control method including: obtaining a pulse width modulation (PWM) signal corresponding to a grayscale of an input image; controlling a current applied to a backlight unit by alternately turning a switching element on and off during a section in which the obtained PWM signal is in an on-state; and providing light to a display panel by using the backlight unit, wherein the controlling the current includes, based on the grayscale of the input image being greater than or equal to a threshold value, alternately turning the switching element on and off based on a first period, and, based on the grayscale of the input image being less than the threshold value, alternately turning the switching element on and off based on a second period which is shorter than the first period.

The grayscale of the input image may include a first grayscale and a second grayscale which are smaller than the threshold value and are continuous among a plurality of grayscales divided according to a luminance of the input image, and wherein the controlling the current may further include alternately turning the switching element on and off at least once, based on the second period, in a difference section between a section in which a PWM signal corresponding to the first grayscale is in the on-state, and a section in which a PWM signal corresponding to the second grayscale is in the on-state.

The controlling the current may further include, based on a duty of the PWM signal being greater than or equal to a value, alternately turning the switching element on and off based on the first period, and, based on the duty of the PWM signal being less than the value, alternately turning the switching element on and off based on the second period.

The control method may further include obtaining a dimming signal corresponding to the grayscale of the input image, and wherein the controlling the current may further include, based on a size of the dimming signal being greater than or equal to a value, alternately turning the switching element on and off based on the first period, and, based on the size of the dimming signal being less than the value, alternately turning the switching element on and off based on the second period.

The control method may further include identifying a grayscale of the input image based on a current applied to the backlight unit, and wherein the controlling the current may further include alternately turning the switching element on and off based on a period according to the identified grayscale.

The control method may further include setting an inductance of a variable inductor connected with the backlight unit, wherein the setting the inductance may include, based on the grayscale of the input image being greater than or equal to a threshold value, setting the inductance of the variable inductor to a first value, and, based on the grayscale of the input image being less than the threshold value, setting the inductance of the variable inductor to a second value which is smaller than the first value.

The controlling the current further may further include: based on the grayscale of the input image being less than or equal to a first threshold value, alternately turning the switching element on and off based on a third period; based on the grayscale of the input image being greater than or equal to a second threshold value, which is greater than the first threshold value, alternately turning the switching element on and off based on a fourth period which is longer than the third period; and based on the grayscale of the input image being greater than the first threshold value and is less than the second threshold value, alternately turning the switching element on and off based on a fifth period, wherein the fifth period may constantly increase from the third period to the fourth period as the grayscale of the input image increases from the first threshold value to the second threshold value.

The controlling the current may further include: based on the grayscale of the input image gradually decreasing and being lower than a first threshold value, alternately turning the switching element on and off based on a third period; and based on the grayscale of the input image gradually increasing and being higher than a second threshold value, alternately turning the switching element on and off based on a fourth period which is longer than the third period, and wherein the first threshold value may be smaller than the second threshold value.

Based on the switching element being turned on, the current applied to the backlight unit may rise, and, based on the switching element being turned off, the current applied to the backlight unit may fall.

BRIEF DESCRIPTION OF THE DRAWINGS

The above and other aspects, features, and advantages of certain embodiments of the present disclosure will be more apparent from the following description taken in conjunction reference to the accompanying drawings, in which.

DETAILED DESCRIPTION

Figure 1:
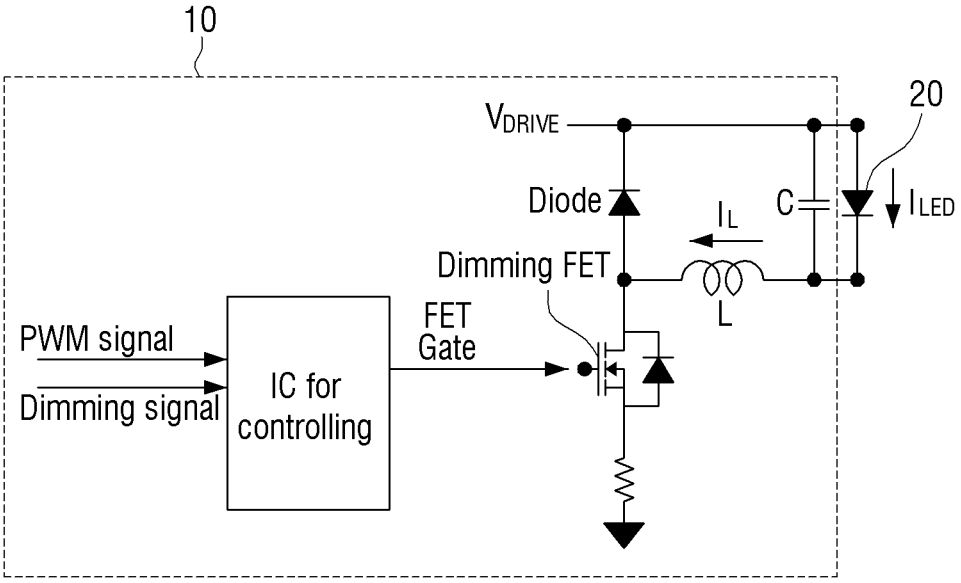
FIG. 1 is a view to illustrate a related-art LED driving circuit.

The terms used in the detailed description and the claims are normal terms which are widely used and selected in consideration of the functions in the present disclosure. However, the terms may be changed according to an intention or a legal or technical interpretation of a person skilled in the art and the advent of new technology. In addition, some terms may be arbitrarily selected by the applicant. These terms may be interpreted as having meanings defined in the detailed description and may be interpreted based on the entire contents of the detailed description and commonly knowledge of an ordinary skilled person in the art if they are not specifically defined.

In the explanation of the drawings, the same reference numerals or signs are used for components or elements performing substantially the same functions. For a convenience of explanation and understanding, the same reference numerals or signs may be used in other embodiments. That is, although elements having the same reference numeral are all illustrated in the plurality of drawings, the plurality of drawings may correspond to different embodiments.

In addition, terms including ordinal numbers such as "first" and "second" may be used in the detailed description and the claims to distinguish elements from one another. The ordinal numbers may be used to distinguish the same or similar elements from one another, and the meaning of terms should not be interpreted as limiting due to the use of the ordinal numbers. For example, an element combined with an ordinal number should not be limited in use order or arrangement order due to the number. The ordinal numbers may be interchangeably used when necessary.

The singular forms are intended to include the plural forms as well, unless the context clearly indicates otherwise. The terms "include" or "is configured" indicate the presence of features, numbers, steps, operations, elements, and components described in the specification, or a combination thereof, and do not preclude the presence or addition of one or more other features, numbers, steps, operation, elements, or components, or a combination thereof.

In addition, the term "module," "unit," or "part" used in embodiments indicates an element performing one or more functions or operations, and may be implemented by using hardware or software or a combination of hardware and software. In addition, a plurality of "modules," a plurality of "units," or a plurality of "parts" may be integrated into one or more modules, except that a "module," "unit," or "part needs to be implemented by specific hardware, and may be implemented as one or more processors.

It will be understood that when an element is "connected with" another element, the element may be "directly connected with" another element, and the element may be "electrically connected with" another element with an intervening element therebetween. In addition, when a certain portion "includes" a certain element, it means that the portion may further include other elements rather than excluding other elements unless the context clearly indicates otherwise.

In embodiments of the present disclosure, a dimming signal refers to a signal for controlling an intensity of a current applied to a backlight unit, and a pulse width modulation (PWM) signal refers to a signal for controlling a time interval at which the dimming signal is applied. A duty of the PWM signal refers to a time for which the PWM signal is inputted or applied within a period of the PWM signal, that is, a length or a ratio of a time for which the PWM signal is in the on-state within the period of the PWM signal (i.e., duty cycle). If the size of the dimming signal is constant, a grayscale of an image may be divided into a plurality of levels of a gap by changing a duty value of the PWM signal by a constant gap. Alternatively, if the duty of the PWM signal is constant, a grayscale of an image may be divided into a plurality of levels of a constant gap by changing the size of the dimming signal by a constant gap.

In general, the grayscale refers to light and shade of pictures, photos, or images, or darkness of color. In embodiments of the present disclosure, the grayscale refers to a degree of luminance of an image displayed. A grayscale level may be used as a term meaning a grayscale corresponding to each level when the grayscale of an image displayed is divided into a plurality of levels of a constant gap.

Hereinafter, the present disclosure will be described in detail with reference to the accompanying drawings.

Figure 2A:
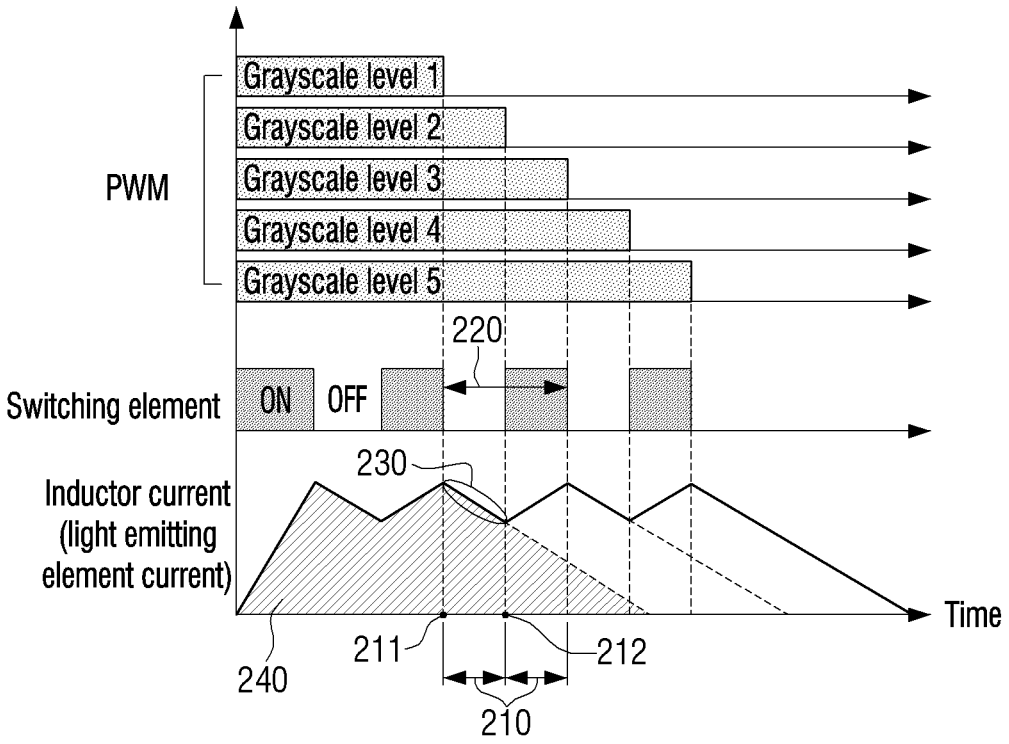
FIGS. 2A and 2B are graphs to illustrate a problem of the related-art LED driving circuit in detail.
Figure 3A:
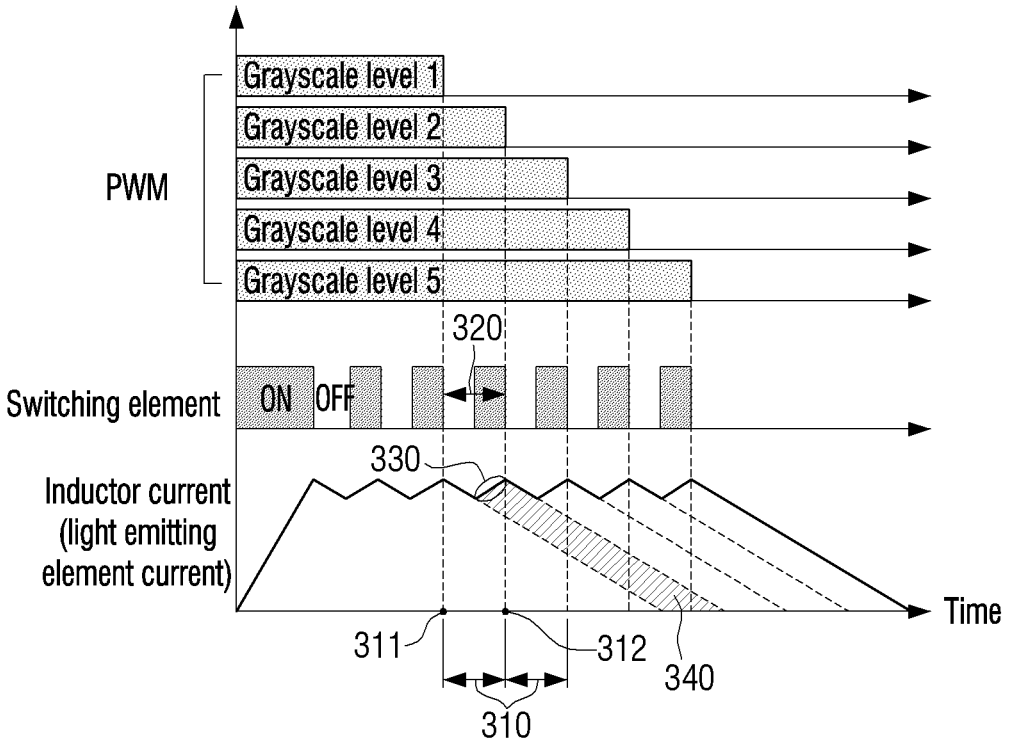
FIGS. 3A and 3B are graphs to illustrate principles to solve the problem of the related-art.
Figure 3B:
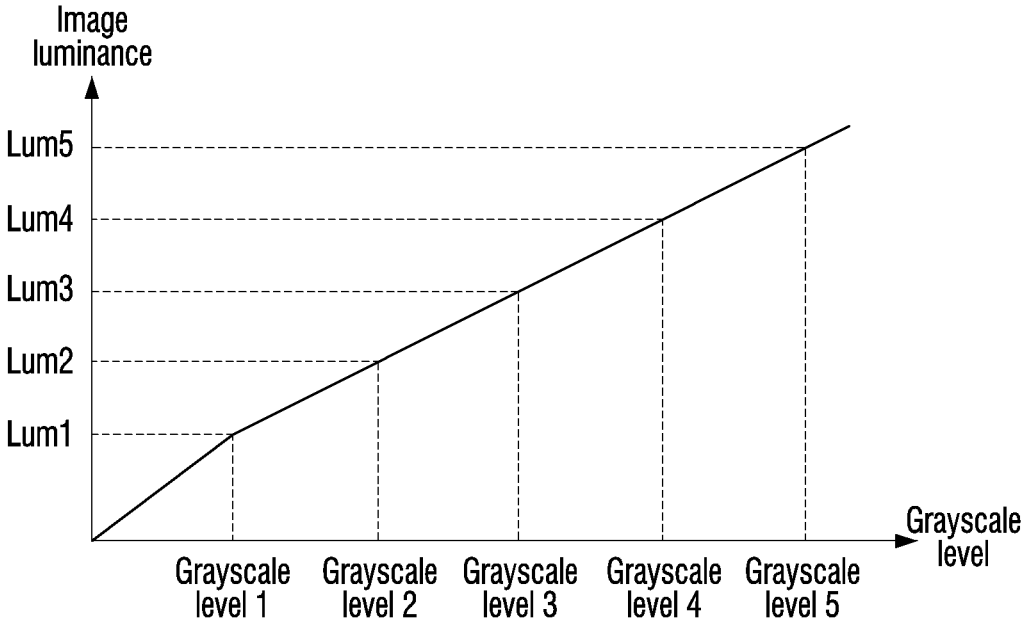

FIGS. 2A and 3B are graphs to illustrate a problem of the related-art LED driving circuit in detail. FIG. 2A illustrates an operation of the driving unit 10 including the switching element such as a dimming FET as shown in FIG. 1.

Referring to FIG. 2A, as the grayscale level of an image to be displayed on the display increases from level 1 to level 5, a duty during which a PWM signal is inputted also increases by a constant gap.

Referring to FIG. 2A, a PWM signal having a duty value corresponding to each grayscale level is applied to the driving unit 10 to apply an amount of a current corresponding to each grayscale level to the light emitting element 20, and the switching element is repeatedly turned on/off during a time section for which the PWM signal applied to the driving unit 10 is in the on-state. In this case, when the switching element is turned on, the current of the light emitting element 20 rises, and, when the switching element is turned off, the current of the light emitting element 20 falls.

However, when a frequency of the PWM signal is 120 Hz or 240 Hz as a typical numerical value, a difference between duty values of the PWM signal corresponding to continuous grayscale levels is only 8.14 μs (=1/120/1024) or 4.07 μs (=1/240/1024) in order to express the grayscale level of the image to be displayed by higher than 1024 levels (10 bits).

As a result, the gap between the duty values of the PWM signal corresponding to the continuous grayscale levels may be shorter than a switching period for which the switching element is turned on or off.

For example, as shown in FIG. 2A, the gap 210 between the duty values of the PWM signal corresponding to the continuous grayscale levels is only half of the period 220 for which the switching element is turned on/off.

Referring to FIG. 2A, when the PWM signal corresponding to grayscale level 1 is inputted, the switching element is in the off-state from a time 211 at which the ON section of the PWM signal corresponding to grayscale level 1 ends until a time at which the period of the PWM signal ends. Therefore, the current applied to the light emitting element 20 continuously falls from the time 211 at which the ON section of the PWM signal corresponding to grayscale level 1 ends.

In addition, in FIG. 2A, when the PWM signal corresponding to grayscale level 2 is inputted, the switching element is in the off-state from a time 212 at which the ON section of the PWM signal corresponding to grayscale level 2 ends until the time at which the period of the PWM signal ends. Therefore, the current applied to the light emitting element 20 continuously falls from the time 212 at which the ON section of the PWM signal corresponding to grayscale level 2 ends.

As a result, as shown in FIG. 2A, although the duty of the PWM signal corresponding to grayscale level 2 is longer than the duty of the PWM signal corresponding to grayscale level 1 by the gap 210, the switching element is in the off-state during the additional time interval for which the PWM signal corresponding to grayscale level 2 further stays in the on-state, compared to the PWM signal corresponding to grayscale level 1. That is, the current applied to the light emitting element 20 falls (230) during the additional time interval. Therefore, the amount of current 240 applied in the case of grayscale level 1 is the same as the amount of current applied in the case of grayscale level 2 (In this case, the amount of current 240 is calculated by integrating the current applied to the light emitting unit with respect to time).

As described above, the same or similar amount of current may be applied to the light emitting element even when the grayscale levels are different, and as a result, there may be a problem that luminance of a displayed image is the same or very similar even when the grayscales of the inputted image are different.

Figure 2B:
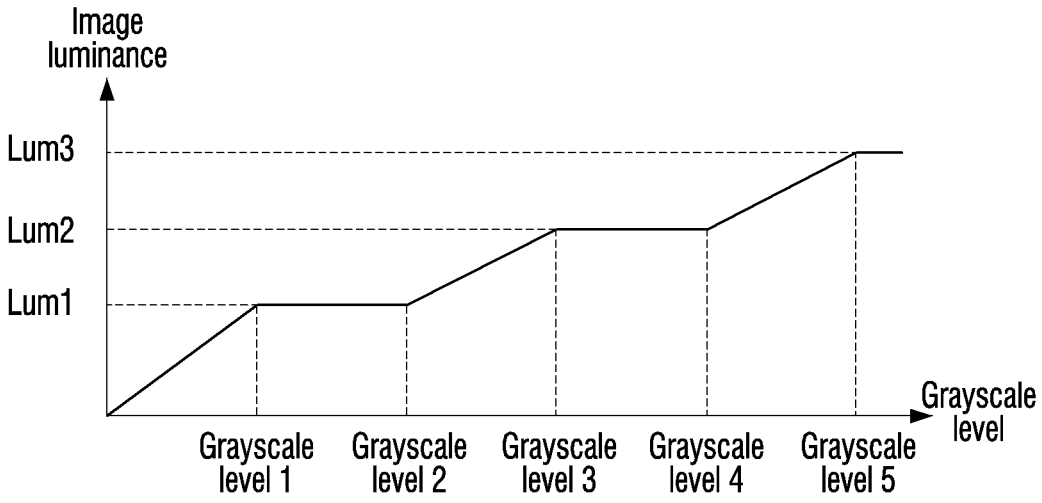

For example, FIG. 2B illustrates luminance of an image according to a grayscale level when a switching period is set as shown in FIG. 2A.

As shown in FIG. 2A, the same amount of current is applied to the light emitting element even when the grayscale levels are different, and as a result, referring to FIG. 2B, the image has the same luminance Lum1 in the case of grayscale level 1 and in the case of grayscale level 2, or has the same luminance Lum2 in the case of grayscale level 3 and in the case of grayscale level 4.

FIGS. 3B and 3B are graphs to illustrate principles to solve the above-described problem.

In the same way as in FIG. 2A, FIG. 3B illustrates that, as the grayscale level of an image to be displayed on a display increases from level 1 to level 5, a duty during which a PWM signal is inputted also increases by a constant gap 310. In the same way as in FIG. 2A, FIG. 3B illustrate an operation of the driving unit 10 including the switching element such as a dimming FET.

Unlike in FIG. 2A, the graph in FIG. 3B indicates that the gap between the duty values of the PWM signal corresponding to continuous grayscale levels is not smaller than a switching period, and it is illustrated that the gap 310 between the duty values of the PWM signal corresponding to the continuous grayscale levels is the same as the switching period 320.

In the same way as in FIG. 2A, referring to FIG. 3B, when the PWM signal corresponding to grayscale level 1 is inputted, the switching element is in the off-state from a time 311 at which the ON section of the inputted PWM signal ends until a time at which the period of the PWM signal ends. Therefore, the current applied to the light emitting element 20 falls. In addition, when the PWM signal corresponding to grayscale level 2 is inputted, the switching element is in the off-state from a time 312 at which the ON section of the inputted PWM signal ends until a time at which the period of the PWM signal ends. Therefore, the current applied to the light emitting element 20 falls.

However, since the switching period 320 of FIG. 3B is shorter than that of FIG. 2A, the additional time interval for which the PWM signal corresponding to grayscale level 2 further stays in the on-state, compared to the PWM signal corresponding to grayscale level 1, includes a section in which the switching element is turned on, that is, a section 330 in which the current of the light emitting element 20 rises.

As a result, there is a difference as much as a constant value 340 in the amount of current applied to the light emitting element between the case of grayscale level 1 and the case of grayscale level 2, and it can be seen that the amount of current increases by the constant value 340 in each PWM period every time the grayscale level increases by one level.

Accordingly, the problem of FIGS. 2A and 2B, in which luminance of the image is the same or similar even if the grayscale levels are different, does not arise.

FIG. 3B illustrates luminance of an image according to a grayscale level when a switching period is set as shown in FIG. 3B.

As shown in FIG. 3B, the amount of current applied to the light emitting element increases by the constant value 340 every time the grayscale level increases by one level. As a result, referring to FIG. 3B, as the grayscale level increases by one level from level 1 to level 5, luminance of the image increases from Lum1 to Lum 5 by a constant value.

As described above, luminance difference according to a grayscale difference of an image can be more ideally implemented than in the related-art method by appropriately controlling the switching period in which the switching element is turned on or off or a switching frequency which is the reciprocal of the switching period.

However, when the switching element is turned on/off according to a relatively short period, real brightness difference can be ideally implemented according to a grayscale difference of an image, but there is a problem that heating of a display apparatus increases. As a result, the method of turning on/off the switching element according to a switching period lower than a predetermined value may be considered only in the case of displaying images of low grayscales, the luminance difference of which is difficult to implement according to grayscale levels in the related-art method.

Figure 4:
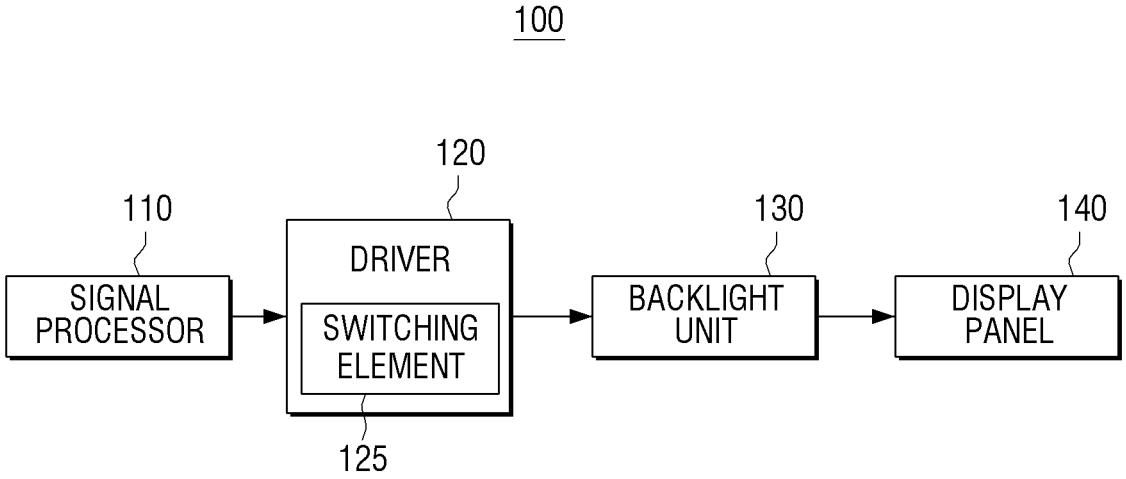
FIG. 4 is a block diagram to illustrate a display apparatus according to an embodiment of the present disclosure.

FIG. 4 is a block diagram of a display apparatus 100 according to an embodiment of the present disclosure, considering the above-described principles. The display apparatus 100 may be implemented by using various types of apparatuses such as a television (TV), a personal computer (PC), a laptop PC, a tablet PC, a monitor, an electronic board, a kiosk, an electronic picture frame, a game player, and a smart phone.

Referring to FIG. 4, the display apparatus 100 may include a signal processor 110, a driver 120, a backlight unit 130, and a display panel 140.

The signal processor 110 may process an image and/or audio signal inputted. In addition, the signal processor 110 may generate a new signal based on the inputted image and/or audio signal.

The signal processor 110 may obtain a PWM signal and/or a dimming signal corresponding to a grayscale of an image, based on grayscale information of the image included in the image signal inputted to the display apparatus 100. In this case, the obtained PWM signal and dimming signal may be provided to the driver 120.

In this case, a duty of the PWM signal and/or a size of the dimming signal may increase as a grayscale value based on the grayscale information of the inputted image increases.

The signal processor 110 may obtain a PWM signal and/or a dimming signal corresponding to a grayscale, based on not only the grayscale information of the image included in the image signal inputted to the display apparatus 100, but also grayscale information according to a user's command.

For example, when a command to increase the grayscale value of the inputted image is received through a user input interface, the signal processor 110 may obtain a PWM signal having a larger duty than that of a PWM signal corresponding to the grayscale of the inputted image, and/or may obtain a dimming signal having a larger size than that of a dimming signal corresponding to the grayscale of the inputted image.

The signal processor 110 may include at least one of an analog-digital (A/D) converter, a digital signal processor (DSP), and an integrated circuit (IC) for processing a signal.

The driver 120 may apply a current to the backlight unit 130, based on the PWM signal and/or the dimming signal provided from the signal processor 110. Specifically, the driver 120 may apply a current to one or more light emitting elements included in the backlight unit 130.

In this case, as the size of the dimming signal increases, a current value applied to the backlight unit 130 increases, and as the duty of the PWM signal increases, a ratio of a time for which a current (a current having a current value corresponding to the size of the dimming signal) is applied to the backlight unit 130 within the same period (period of the PWM signal) increases.

The driver 120 may be implemented in as software/hardware, and specifically, may include an electronic circuit to apply a current corresponding to the PWM signal and/or the dimming signal to the backlight unit 130.

In this case, the circuit included in the driver 120 may include a switching element 125, and the driver 120 may control on/off of the switching element 125. Alternatively, the driver 120 may not physically include the switching element, but may electronically connected to control on/off the switching element.

The switching element 125 may be implemented by using a metal oxide semiconductor field effect transistor (MOSFET), a power MOSFET, a bipolar junction transistor (BJT), or the like. However, in addition to the above-described elements, any element that can be controlled to have two or more output states based on one or more inputs may be used to implement to the switching element 125.

The driver 120 may control the current applied to the backlight unit 130 by using the switching element 125.

For example, the driver 120 may control the current applied to each light emitting element included in the backlight unit 130, to rise or fall, by turning on or off the switching element 125. To achieve this, the driver 120 may include at least one of a voltage input terminal to receive energy, an inductor, and a capacitor.

The driver 120 may apply a current to the backlight unit 130 by repeatedly turning on/off the switching element 125 during a section in which the PWM signal provided from the signal processor 110 is in the on-state.

The driver 120 may include an IC, which is electronically connected with the switching element 125, to control the switching element 125. In this case, the IC for controlling may receive the PWM signal and/or the dimming signal and may control the operation of the switching element 125.

The backlight unit 130 may be configured to generate light and to provide the light to the display panel 140. To achieve this, the backlight unit 130 may include one or more light emitting elements, and may be disposed on the rear surface of the display panel 140 to emit light toward the display panel 140 in order for the display panel 140 to display an image.

The light emitting element is a light source that may emit light. The light emitting element may be implemented by using an LED, and may receive a current controlled by the driver 120 and emit light.

The display panel 140 may be configured to display an image. To achieve this, the display panel 140 may be implemented by using a liquid crystal display (LCD), and may receive light from the backlight unit 130 and display an image.

Unlike in FIG. 4, a single LED display rather than the backlight unit 130 and the display panel 140 may be included in the display apparatus 100. In this case, the LED display may include one or more light emitting elements controlled by the driver 120.

The driver 120 may control a current to be applied to the backlight unit 130 by turning on/off the switching element 125 according to a period corresponding to a grayscale of an image inputted to the display apparatus 100. In this case, the driver 120 may turn on/off the switching element 125 according to a relatively short period only in the case that the inputted image has a low grayscale.

For example, when the grayscale of the inputted image is greater than or equal to a predetermined threshold value, the driver 120 may turn on/off the switching element 125 based on a first period, and, when the grayscale of the inputted image is less than the predetermined threshold value, the driver 120 may turn on/off the switching element 125 based on a second period, which is shorter than the first period.

Figure 5:
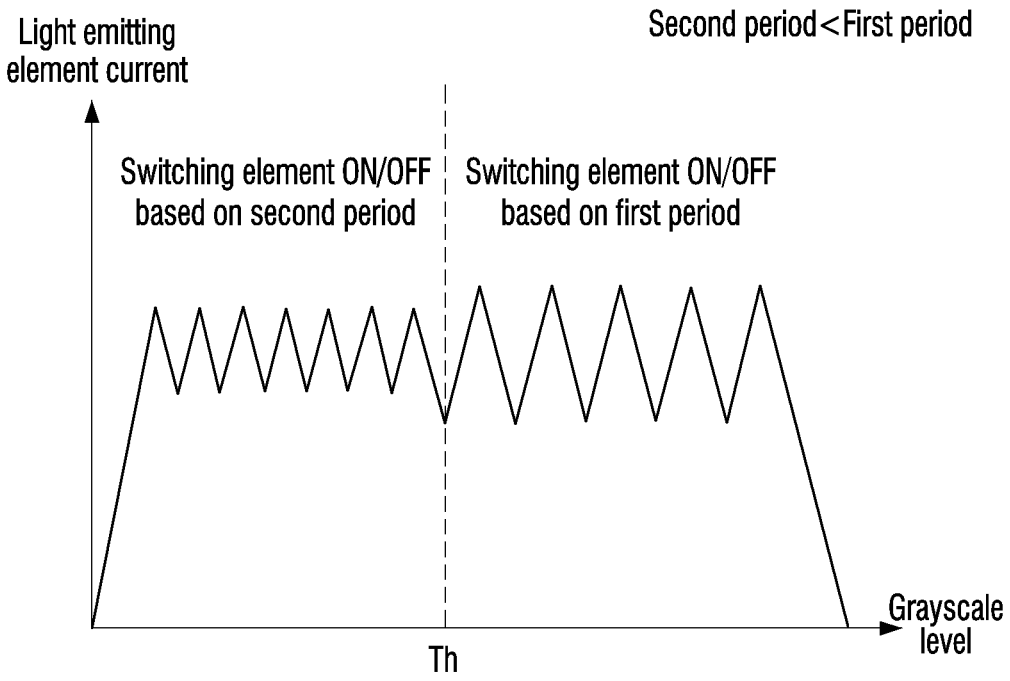
FIG. 5 is a graph illustrating rising and falling of an LED current according to an on/off period of a switching element.

FIG. 5 is a graph illustrating a current of the light emitting element included in the backlight unit 130 when a switching period varies according to a grayscale.

As shown in FIG. 5, when a grayscale of an inputted image is lower than a predetermine grayscale level (Th), the driver 120 may turn on/off the switching element 125 based on the second period, and, when the grayscale of the inputted image is higher than the predetermined grayscale level (Th), the driver 120 may turn on/off the switching element 125 based on the first period which is longer than the second period.

In this case, the second period may be a period in which an increase rate of an amount of current applied to the backlight unit 130 according to the increase of the grayscale of the inputted image falls within a predetermined error rage with reference to a specific value.

For example, among a plurality of grayscales corresponding to a plurality of grayscale levels, first and second grayscales smaller than the predetermined grayscale level (Th) and corresponding to continuous grayscale levels may be compared.

In this case, the driver 120 may turn on/off the switching element 125, such that the switching element 125 is turned on and off at least once during a difference section between a section in which a PWM signal corresponding to the first grayscale is in the on-state, and a section in which a PWM signal corresponding to the second grayscale is in the on-state, within the period of the PWM signal.

In other words, the driver 120 may turn on/off the switching element 125 based on the second period, in which the switching element 125 is turned on and off at least once during the difference section between the section in which the PWM signal corresponding to the first grayscale is in the on-state, and the section in which the PWM signal corresponding to the second grayscale is in the on-state, within the period of the PWM signal.

For example, as shown in FIG. 3B, when the driver 120 turns on/off the switching element 125 based on the period 320 which is the same as the difference 310 between the duty of the PWM signal corresponding to grayscale level 1 and the duty of the PWM signal corresponding to the grayscale level 2, the switching element 125 may be turned on and off once during the difference section between the section in which the PWM signal corresponding to grayscale level 1 is in the on state, and the section between the PWM signal corresponding to the grayscale level 2 is in the on state. As a result, a luminance difference between images corresponding to continuous grayscale levels may be constant.

As described above, the grayscale of the inputted image may be implemented based on the duty of the PWM signal and/or the intensity of the dimming signal. Accordingly, the driver 120 may turn on/off the switching element 125 according to the period based on the duty of the PWM signal and/or the size of the dimming signal, which are provided from the signal processor 110.

For example, when the duty of the PWM signal provided from the signal processor 110 is greater than or equal to a predetermined value, the driver 120 may turn on/off the switching element 125 based on the first period, and, when the duty of the PWM signal is less than the predetermined value, the driver 120 may turn on/off the switching element 125 based on the second period which is shorter than the first period.

Alternatively, when the size of the dimming signal provided from the signal processor 110 is greater than or equal to a predetermined value, the driver 120 may turn on/off the switching element 125 based on the first period, and, when the size of the dimming signal is less than the predetermined value, the driver 120 may turn on/off the switching element 125 based on the second period which is shorter than the first period.

In the above-described embodiments, the driver 120 controls the on/off period of the switching element 125 in a dichotomous way with reference to the single predetermined grayscale level (Th). However, the driver 120 may set a plurality of threshold values for grayscale values (or levels), and may control the on/off period of the switching element 125 in various ways with reference to the plurality of threshold values. In this case, the driver 120 may set a plurality of threshold values for the duty of the PWM signal and/or the size of the dimming signal, and may control the on/off period of the switching element 124 in various ways with reference to the plurality of threshold values.

For example, when the grayscale of the input image is less than or equal to a predetermined first threshold value, the driver 120 may turn on/off the switching element 125 based on a third period, and, when the grayscale of the input image is greater than or equal to a predetermined second threshold value, which is greater than the predetermined first threshold value, the driver 120 may turn on/off the switching element 125 based on a fourth period which is longer than the third period.

In this case, when the grayscale of the input image is greater than the predetermined first threshold value and is less than the predetermined second threshold value, the driver 120 may turn on/off the switching element 125 based on a fifth period rather than the third period or fourth period. In this case, the fifth period may be a value that constantly increases from the third period to the fourth period as the grayscale of the input image increases from the predetermined first threshold value to the predetermined second threshold value.

Figure 6A:
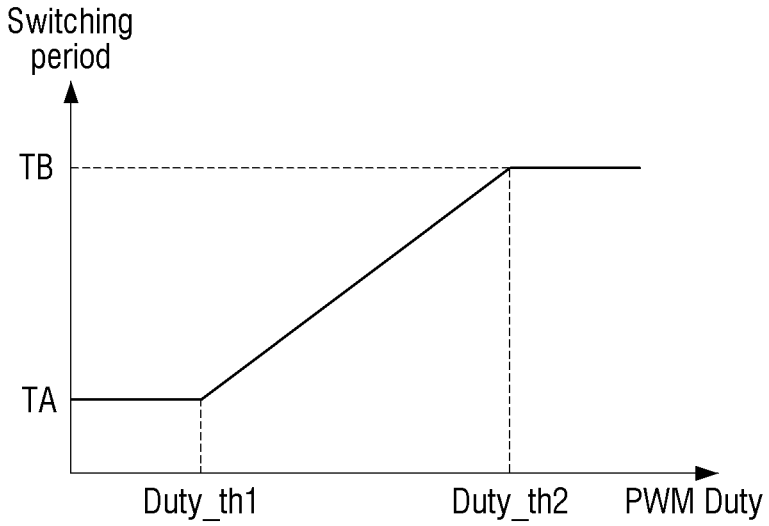
FIGS. 6A and 6B are graphs to illustrate a method for controlling an on/off period of a switching element to correspond to a characteristic of a PWM signal or a dimming signal.
Figure 6B:
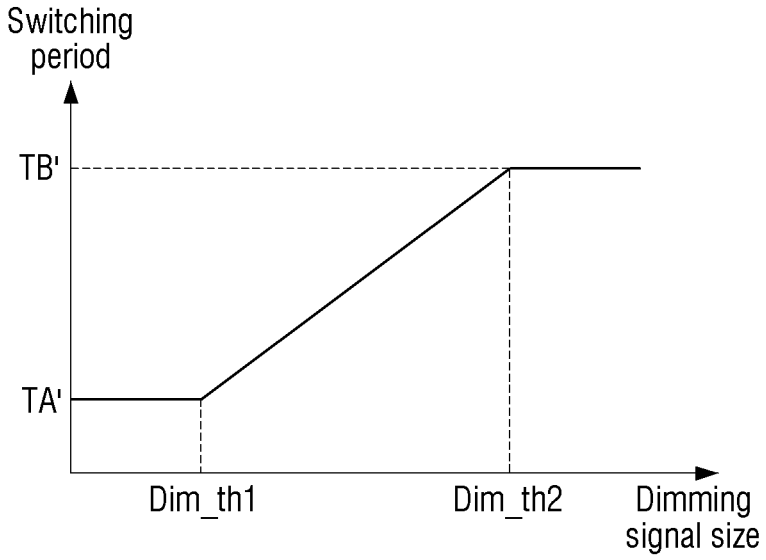

FIGS. 6B and 6B are graphs illustrating an embodiment in which the driver 120 turns on/off the switching element 125 based on a period according to a characteristic of a PWM signal or a dimming signal corresponding to a grayscale of an input image.

Referring to FIG. 6B, when the duty of the PWM signal is less than or equal to Duty_th1, the driver 120 may turn on/off the switching element 125 based on a period TA. In addition, when the duty of the PWM signal is greater than or equal to Duty_th2 which is greater than Duty_th1, the driver 120 may turn on/off the switching element 125 based on a period TB, which is longer than the period TA.

Referring to FIG. 6B, when the duty of the PWM signal is greater than Duty_th1 and less than Duty_th2, the driver 120 may turn on/off the switching element 125 based on a period having a value constantly increasing from TA to TB as the duty of the PWM signal constantly increases from Duty_th1 to Duty_th2.

The size of the dimming signal rather than the PWM signal may be considered. For example, referring to FIG. 6B, when the size of the dimming signal is less than Dim_th1, the driver 120 may turn on/off the switching element 125 based on a period TA'. In addition, when the size of the dimming signal is greater than or equal to Dim_th2 which is greater than Dim_th1, the driver 120 may turn on/off the switching element 125 based on a period TB', which is longer than the period TA'.

Referring to FIG. 6B, when the size of the dimming signal is greater than Dim_th1 and less than Dim_th2, the driver 120 may turn on/off the switching element 125 based on a period having a value constantly increasing from TA' to TB' as the size of the dimming signal constantly increases from Dim_th1 to Dim_th2.

The driver 120 may turn on/off the switching element 125 based on a period having a hysteresis characteristic according to a change in the grayscale of the input image.

Specifically, when the grayscale of the input image gradually decreases and is lower than the predetermined first threshold value, the driver 120 may turn on/off the switching element 125 based on the third period, and, when the grayscale of the input image gradually increases and is higher than the predetermined second threshold value, the driver 120 may turn on/off the switching element 125 based on the fourth period which is longer than the third period. In this case, the predetermined first threshold value may be smaller than the predetermined second threshold value.

Figure 7A:
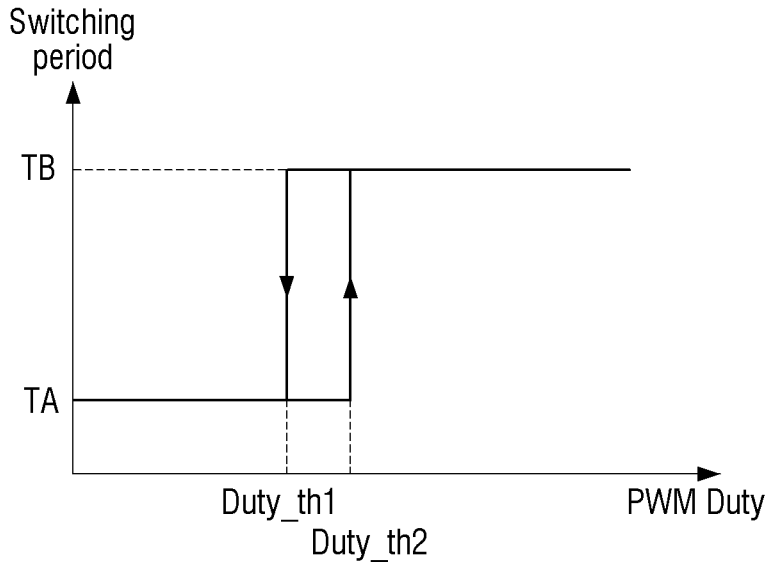
FIGS. 7A and 7B are graphs to illustrate a method for controlling an on/off period of a switching element, different from the method of FIG. 6.
Figure 7B:
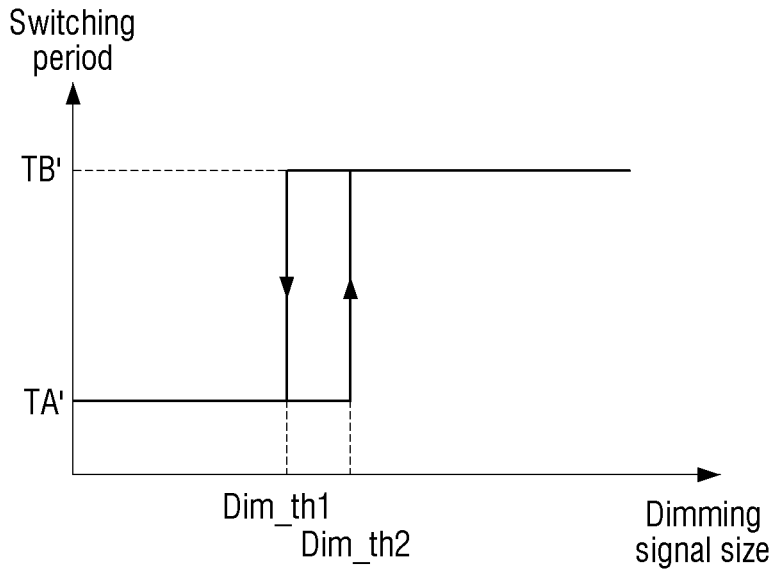

FIGS. 7A and 7B are graphs illustrating an embodiment in which the driver 120 turns on/off the switching element 125 based on a period according to a characteristic of a PWM signal or a dimming signal corresponding to a grayscale of an input image.

Referring to FIG. 7A, when the duty of the PWM signal gradually decreases and is smaller than Duty_th1, the driver 120 may turn on/off the switching element 125 based on the period TA. In addition, when the duty of the PWM signal gradually increases and is greater than Duty_th2, the driver 120 may turn on/off the switching element 125 based on the period TB which is longer than the period TA.

Referring to FIG. 7A, since Duty_th1 is smaller than Duty_th2, the on/off period of the switching element 125 according to the duty of the PWM signal may have a hysteresis characteristic.

Referring to FIG. 7B, when the size of the dimming signal gradually decreases and is smaller than Dim_th1, the driver 120 may turn on/off the switching element 125 based on the period TA'. In addition, when the size of the dimming signal gradually increases and is greater than Dim_th2, the driver 120 may turn on/off the switching element 125 based on the period TB' which is longer than the period TA'.

Referring to FIG. 7B, since Dim_th1 is smaller than Dim_th2, the on/off period of the switching element 125 according to the size of the dimming signal may have a hysteresis characteristic.

Although various embodiments have been described through the graphs of FIGS. 5 to 7B, the embodiment in which the driver 120 controls the on/off period of the switching element 125 based on at least one of the grayscale, the duty of the PWM signal, and the size of the dimming signal according to the present disclosure is not limited to the above-described embodiments.

The driver 120 may turn on or off the switching element 125 by inputting a control signal for the switching element 125, and as a result, may control the on/off period of the switching element 125.

For example, when the switching element 125 is a MOSFET or a power MOSFET, the driver 120 may apply a variable control voltage for a gate terminal of the switching element 125. As a result, the driver 120 may control the on/off period of the switching element 125 by controlling on/off of the switching element 125.

The driver 120 may control a time Toff for which the switching element 125 is in the off-state to control the on/off period of the switching element 125. In this case, when the driver 120 increases Toff, the on/off period of the switching element 125 may increase, and, when the driver 120 reduces Toff, the on/off period of the switching element 125 may be reduced.

To achieve this, the driver 120 may include an IC for controlling to adjust a control signal for the switching element 125 by using at least one of a resistor element, a switch, and a logic element.

Figure 8:
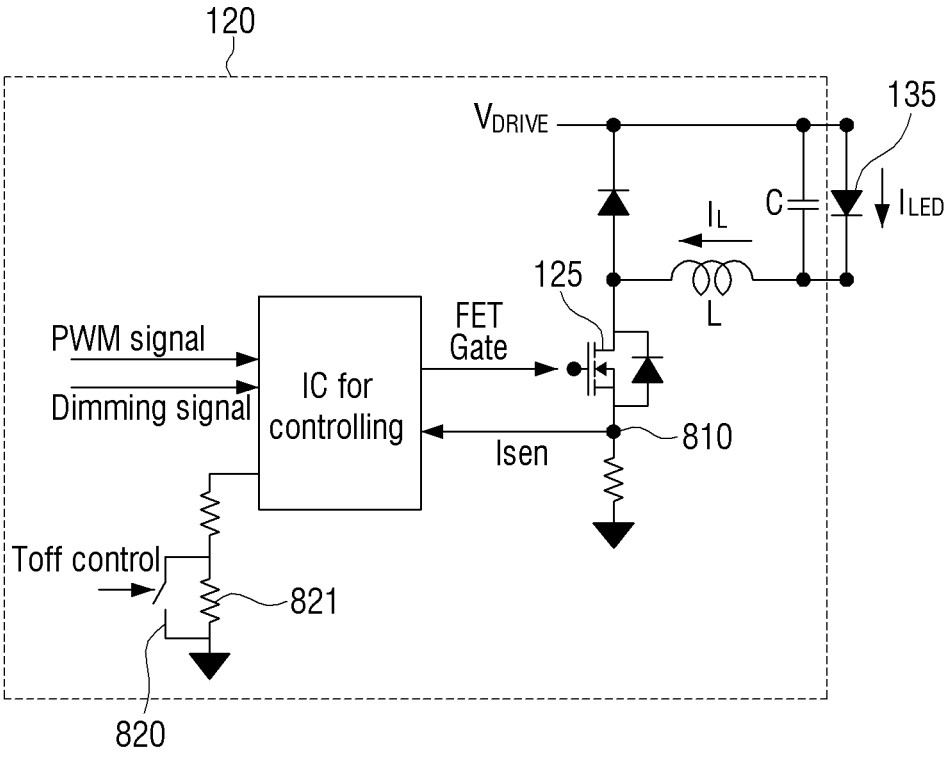
FIG. 8 is a view schematically illustrating a driver included in a display apparatus according to an embodiment of the present disclosure.

FIG. 8 is a view illustrating an example of the driver 120 included in the display apparatus 100 of the present disclosure.

Referring to FIG. 8, the "IC for controlling" included in the driver 120 may control the switching element 125 based on an inputted PWM signal and/or dimming signal. Specifically, the "IC for controlling" may turn on/off the switching element 125 based on a period corresponding to the inputted PWM signal and/or dimming signal, by controlling a "FET Gate" signal inputted to a gate terminal of the switching element 125, which is a power MOSFET.

Referring to FIG. 8, the driver 120 may control the "FET Gate" signal by controlling a connection relationship between a resistor 821 and the "IC for controlling" by using a switch 820 connected with the resistor 821 in parallel. Accordingly, Toff may be controlled in two states, and as a result, the on/off period of the switching element 125 may be controlled in two states.

The driver 120 may identify the grayscale of the input image based on a value which is a measurement value of a current applied to the backlight unit 130, and may turn on/off the switching element 125 based on a period according to the identified grayscale.

Specifically, as a result of detecting the current flowing in the backlight unit 130, the driver 120 may identify what value the grayscale of the current input image displayed on the display panel 140 has, and may control the on/off period of the switching element 125 based on the identified grayscale.

Referring to FIG. 8, the "IC for controlling" included in the driver 120 may identify the grayscale of the input image currently displayed on the display panel 140, based on a result of detecting (Isen) the current flowing in a light emitting element 135 of the backlight unit 130 and the inductor L at a specific point 810, and may control Toff and the on/off period of the switching element based on the identified grayscale. In this case, the current flowing at the specific point 810 may be detected by using a current sensor.

The driver 120 may include a variable inductor connected with the backlight unit 130. Specifically, the driver 120 may include a variable inductor electronically connected with the backlight unit 130 to allow a current to be applied to the backlight unit 130 to flow.

The driver 120 may set or control an inductance of the variable inductor. Specifically, when the grayscale of the input image is greater than or equal to a predetermined threshold value, the driver 120 may set the inductance of the variable inductor to a first value, and, when the grayscale of the input image is less than the predetermined threshold value, the driver 120 may set the inductance of the variable inductor to a second value which is smaller than the first value.

Specifically, when the on/off period of the switching element 125 is short, each section in which the switching element 125 is turned on or off is very short in time. Therefore, the current applied to the backlight unit 130 should rapidly rise and fall for the short time. Accordingly, when the on/off period of the switching element 125 is short, the driver 120 may reduce the inductance value of the variable inductor.

Figure 9A:
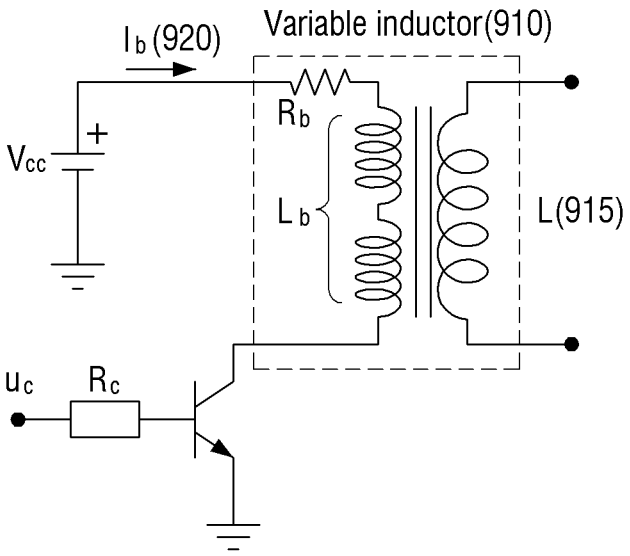
FIGS. 9A and 9B are a view and a graph to illustrate examples of a configuration and an operation of a variable inductor according to an on/off period of a switching element.
Figure 9B:
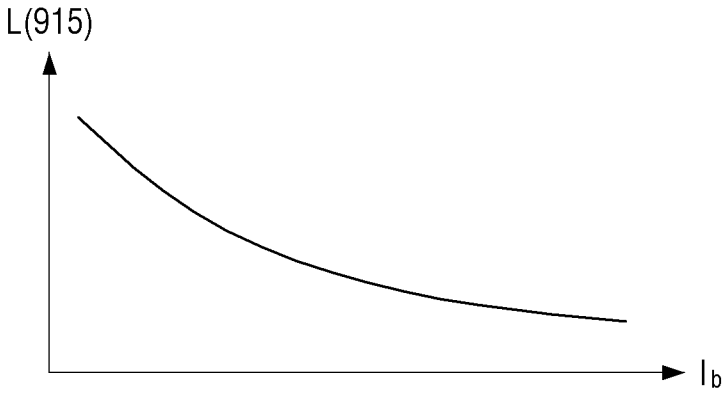

FIGS. 9A and 9B are a view and a graph to illustrate examples of a configuration and an operation of a variable inductor.

FIG. 9A illustrates a normal configuration of a variable inductor 910. An inductance L 915 of the variable inductor 910 may be controlled by controlling a current $I_b$ 920 inputted to the variable inductor 910.

FIG. 9B illustrates a value of the inductance L 915 according to the current $I_b$ 920. As the current $I_b$ 920 increases, the inductance L 915 of the variable inductor 910 decreases.

Accordingly, as the on/off period of the switching element 125 is shorter, the driver 120 including the variable inductor 910 may increase the current $I_b$ 920 inputted to the variable inductor 910.

Figure 10:
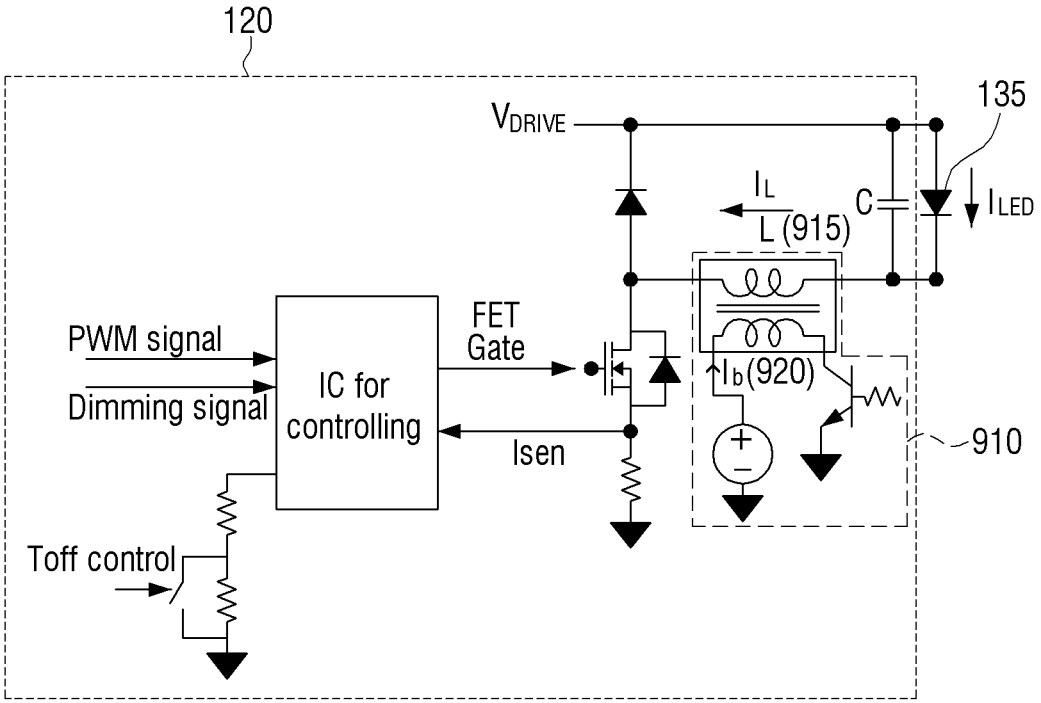
FIG. 10 is a view illustrating an example of coupling the driver of FIG. 8 and the variable inductor of FIG. 9.

FIG. 10 is a view illustrating an example of substituting the inductor of the driver 120 of FIG. 8 with the variable inductor 910 of FIG. 9.

As shown in FIG. 10, the driver 120 including the variable inductor 910 may variably set the value of the inductance L 915 according to the on/off period of the switching element 125.

Figure 11A:
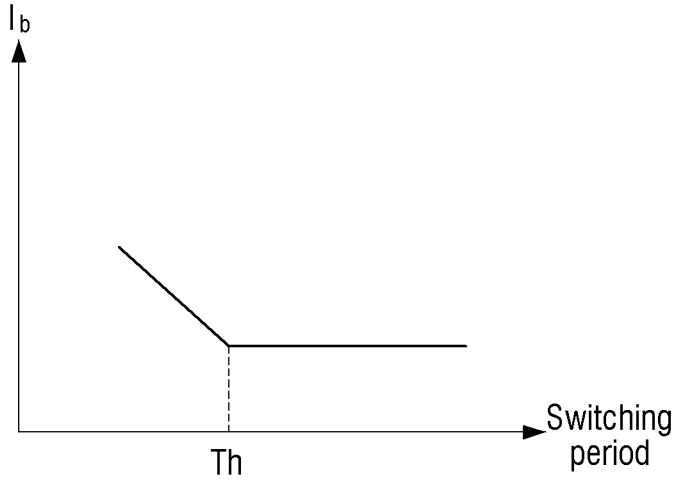
FIGS. 11A and 11B are graphs illustrating an example of controlling a variable inductor according to an on/off period of a switching element.
Figure 11B:
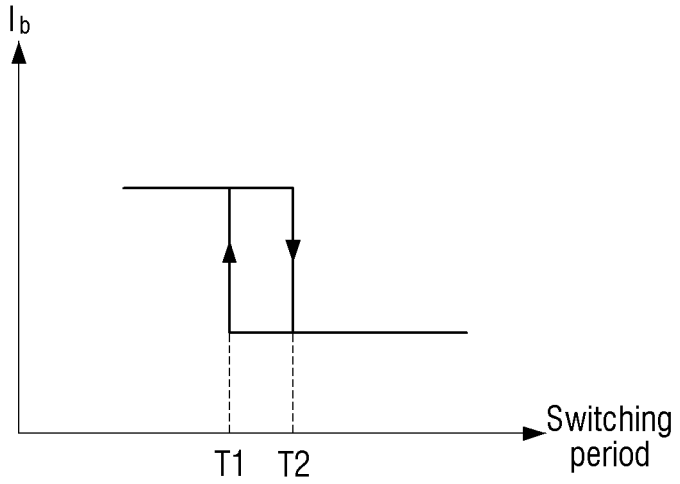

FIGS. 11A and 11B are graphs illustrating an example of controlling, by the driver 120, the variable inductor 910, and are graphs illustrating the current $I_b$ 920 according to the on/off period of the switching element 125.

Referring to FIG. 11A, when the on/off period of the switching element 125 is higher than Th, the driver 120 may constantly maintain the current $I_b$ 920. However, when the on/off period of the switching element 125 is smaller than Th, the driver 120 may gradually increase the current $I_b$ 920 inputted to the variable inductor 920 as the on/off period of the switching element 125 gradually decreases.

Referring to FIG. 11B, when the on/off period of the switching element 125 gradually decreases and is lower than T1, the driver 120 may control the current $I_b$ 920 to reach a maximum value. On the other hand, when the on/off period of the switching element 125 gradually increases and is higher than T2, the driver 120 may control the current $I_b$ 920 to reach a minimum value. As can be seen from FIG. 11B, T1 is smaller than T2. Therefore, the driver 120 may control the current $I_b$ 920 according to the on/off period of the switching element 125, that is, the value of the inductance L 915, to have a hysteresis characteristic.

However, the embodiment in which the driver 120 variably sets the value of the current $I_b$ 920 according to the on/off period of the switching element 125 is not limited to the embodiment of FIGS. 11A and 11B.

Figure 12:
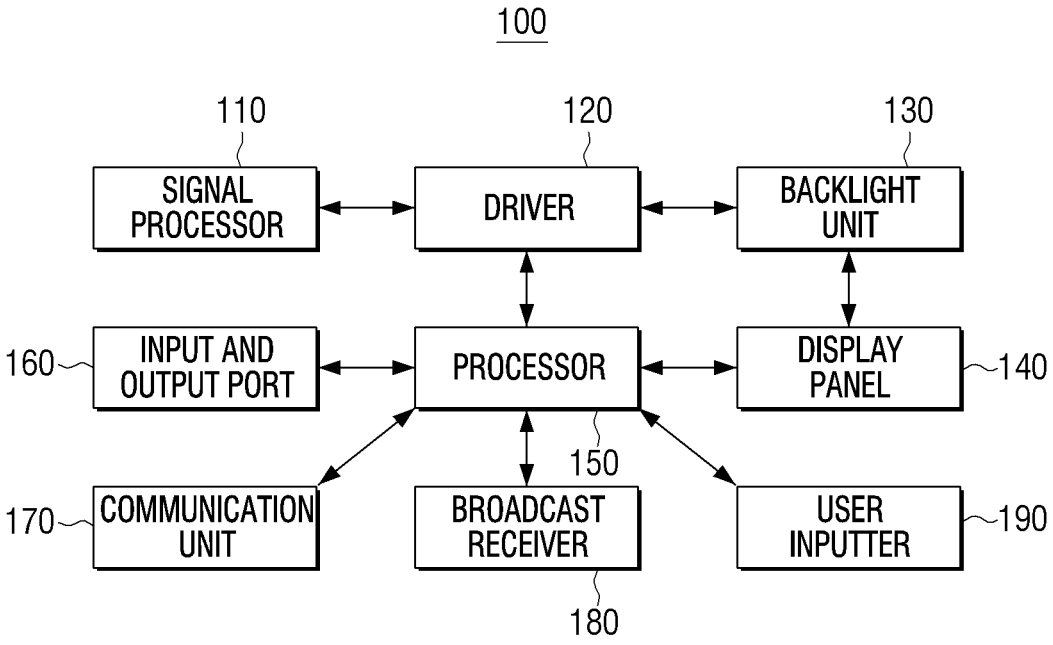
FIG. 12 is a block diagram of a display apparatus according to various embodiments of the present disclosure.

FIG. 12 is a block diagram of a display apparatus according to various embodiments of the present disclosure.

Referring to FIG. 12, the display apparatus 100 may further include at least one of a processor 150, an input and output port 160, a communication unit 170, a broadcast receiver 180, and a user inputter 190, in addition to the signal processor 110, the driver 120, the backlight unit 130, and the display panel 140.

The processor 150 may control an overall operation of the display apparatus 100.

To achieve this, the processor 120 may include a random access memory (RAM), a read only memory (ROM), a central processing unit (CPU), a graphic processing unit (GPU), and a system bus, and may perform calculation or data processing related to control of other elements included in the display apparatus 100.

The processor 150 may obtain grayscale information of an input image based on data regarding the input image, and then provide the grayscale information to the signal processor 110, and as a result, may control the signal processor 110 to generate a PWM signal and/or a dimming signal corresponding to the grayscale information.

The display apparatus 100 may receive an image signal from the outside or may transmit an image signal to the outside through the input and output port 160.

To achieve this, the input and output port 160 may be implemented by using a wired port such as an HDMI port, a display port, an RGB port, a digital visual interface (DVI) port, a Thunderbolt port, and a component port. Alternatively, the input and output port 160 may be implemented by using a port for wireless communication, such as WiFi or Bluetooth communication.

The communication unit 170 is configured to communicate with various types of external devices according to various types of communication methods. The communication unit 170 may include a WiFi chip or a Bluetooth chip.

The processor 150 may communicate with various external devices by using the communication unit 170. The communication unit 170 may perform data communication with an external device wirelessly or wiredly.

When the communication unit 170 performs data communication with an external device in a wireless communication method, the communication unit 170 may include at least one of a WiFi direct communication module, a Bluetooth module, an infrared data association (IrDA) module, a near field communication (NFC) module, a Zigbee module, a cellular communication module, a 3rd generation (3G) mobile communication module, a 4th generation (4G) mobile communication module, and a 4G long term evolution (LTE) communication module.

The broadcast receiver 180 may receive a signal regarding a broadcast content. The broadcast content may include an image, an audio, and additional data (for example, an electronic program guide (EPG)), and the broadcast receiver 180 may receive a broadcast content signal from various sources, such as a terrestrial broadcast, a cable broadcast, a satellite broadcast, an Internet broadcast, or the like.

The broadcast receiver 180 may be implemented to include a configuration such as a tuner, a demodulator, and an equalizer, to receive a broadcast content transmitted from a broadcasting station.

The display apparatus 100 may display an input image on the display panel 140, based on a signal or data regarding the input image received through the input and output port 160, the communication unit 170, and the broadcast receiver 180.

To achieve this, the processor 150 may obtain grayscale information of the input image included in the signal or data of the input image, and may provide the grayscale information to the signal processor 110. In addition, the signal processor 110 may obtain a PWM signal and/or a dimming signal corresponding to the grayscale of the input image, based on the grayscale information, and may provide the PWM signal and/or dimming signal to the driver 120. After that, the driver 120 may control a current to be applied to the backlight unit 130, by controlling the switching element 125 based on a period corresponding to the PWM signal and/or dimming signal. As a result, the backlight unit 130 may convert the applied current into light and provide the light to the display panel 140.

In an embodiment, the signal processor 110 rather than the processor 150 may directly obtain the grayscale information from the inputted image.

The user inputter 190 may receive a user command regarding what grayscale is used to display the input image on the display panel 140.

The user inputter 190 may include a microphone to receive a user command in the form of a voice, or may be implemented as a touch screen along with the display panel 140 to receive a user command in the form of a touch, or may be implemented as a separate touch pad.

In addition, the user inputter 190 may receive a signal including a user command from a remote control device for controlling the display apparatus 100.

According to another embodiment of the present disclosure, the driver 120 may apply a current to the backlight unit 130 by turning on/off the switching element 125, based on a predetermined period in each sub section belonging to the on section of the PWM signal.

In this case, the predetermined period may be pre-set based on at least one of a degree of nonlinearity indicating that an amount of current applied to the backlight unit 130 changes according to a change in the grayscale of the image, and a degree of heating of the display apparatus 100.

Figure 13:
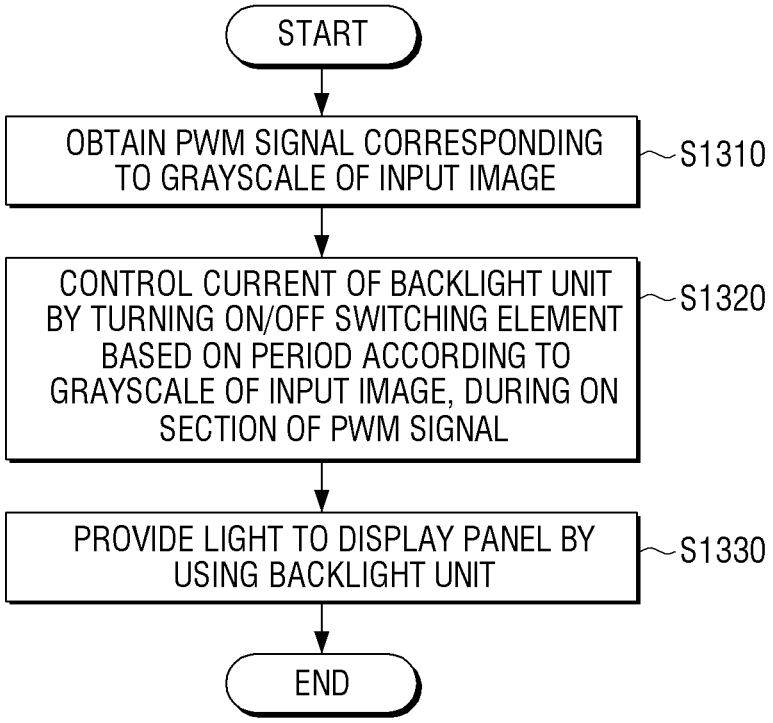
FIG. 13 is a sequence diagram illustrating a control method of a display apparatus according to an embodiment of the present disclosure.

FIG. 13 is a sequence diagram illustrating a control method of a display apparatus according to an embodiment of the present disclosure.

Referring to FIG. 13, the control method obtains a PWM signal corresponding to a grayscale of an input image inputted to the display apparatus (S1310).

Specifically, the control method may identify a grayscale of the input image based on grayscale information included in a signal of the input image inputted to the display apparatus, and may generate a PWM signal corresponding to the identified grayscale.

In addition, during a section in which the obtained PWM signal is in the on-state the control method may control a current of a backlight unit by turning on/off a switching element based on a period according to the grayscale of the input image (S1320). In this case, when the switching element is turned on, the current applied to the backlight unit may rise, and, when the switching element 125 is turned off, the current applied to the backlight unit may fall.

In this case, when the grayscale of the input image is greater than or equal to a predetermined threshold value, the control method may turn on/off the switching element based on a first period, and, when the grayscale of the input image is less than the predetermined threshold value, the control method may turn on/off the switching element based on a second period, which is shorter than the first period.

The grayscale of the input image may include a first grayscale and a second grayscale which are less than the predetermined threshold value and are continuous, among a plurality of grayscales divided according to luminance of the input image. In this case, based on the second period, the switching element may be turned on and off at least once in a difference section between a section in which a PWM signal corresponding to the first grayscale is in the on-state, and a section in which a PWM signal corresponding to the second grayscale is in the on-state.

That is, by turning on/off the switching element based on the second period, the switching element may be turned on and off at least once during the difference section between the section in which the PWM signal corresponding to the first grayscale is in the on-state, and the section in which the PWM signal corresponding to the second grayscale is in the on-state, within the PWM period.

When a duty of the PWM signal is greater than or equal to a predetermined value, the control method may turn on/off the switching element based on the first period, and, when the duty of the PWM signal is less than the predetermined value, the control method may turn on/off the switching element based on the second period.

Alternatively, the control method may obtain a dimming signal corresponding to the grayscale of the input image, and, when the size of the dimming signal is greater than or equal to a predetermined value, the control method may turn on/off the switching element based on the first period, and, when the size of the dimming signal is less than the predetermined value, the control method may turn on/off the switching element based on the second period.

Alternatively, when the grayscale of the input image is less than or equal to a predetermined first threshold value, the control method may turn on/off the switching element based on a third period, and, when the grayscale of the input image is greater than or equal to a predetermined second threshold value, which is greater than the predetermined first threshold value, the control method may turn on/off the switching element based on a fourth period which is longer than the third period. When the grayscale of the input image is greater than the predetermined first threshold value and is less than the predetermined second threshold value, the control method may turn on/off the switching element based on a fifth period. In this case, the fifth period may constantly increase from the third period to the fourth period as the grayscale of the input image increases from the predetermined first threshold value to the predetermined second threshold value.

Alternatively, when the grayscale of the input image gradually decreases and is lower than the predetermined first threshold value, the control method may turn on/off the switching element based on the third period, and, when the grayscale of the input image gradually increases and is higher than the predetermined second threshold value, the control method may turn on/off the switching element based on the fourth period which is longer than the third period. In this case, the predetermined first threshold value may be smaller than the predetermined second threshold value.

The control method may provide light to a display panel by using the backlight unit (S1330). Specifically, the backlight unit may convert the applied current into light, and may provide the light to the display panel.

The control method of the display apparatus may variably set an inductance of a variable inductor connected with the backlight unit. This is to prevent a problem that the current of the backlight unit does not sufficiently rise and fall as the on/off period of the switching element becomes shorter.

In this case, when the grayscale of the input image is greater than or equal to a predetermined threshold value, the control method may set the inductance of the variable inductor to a first value, and, when the grayscale of the input image is less than the predetermined threshold value, the control method may set the inductance of the variable inductor to a second value which is smaller than the first value.

When the input image is displayed on the display panel, the control method may identify the grayscale of the input image based on the current applied to the backlight unit, and then may turn on/off the switching element based on a period according to the identified grayscale.

Figure 14:
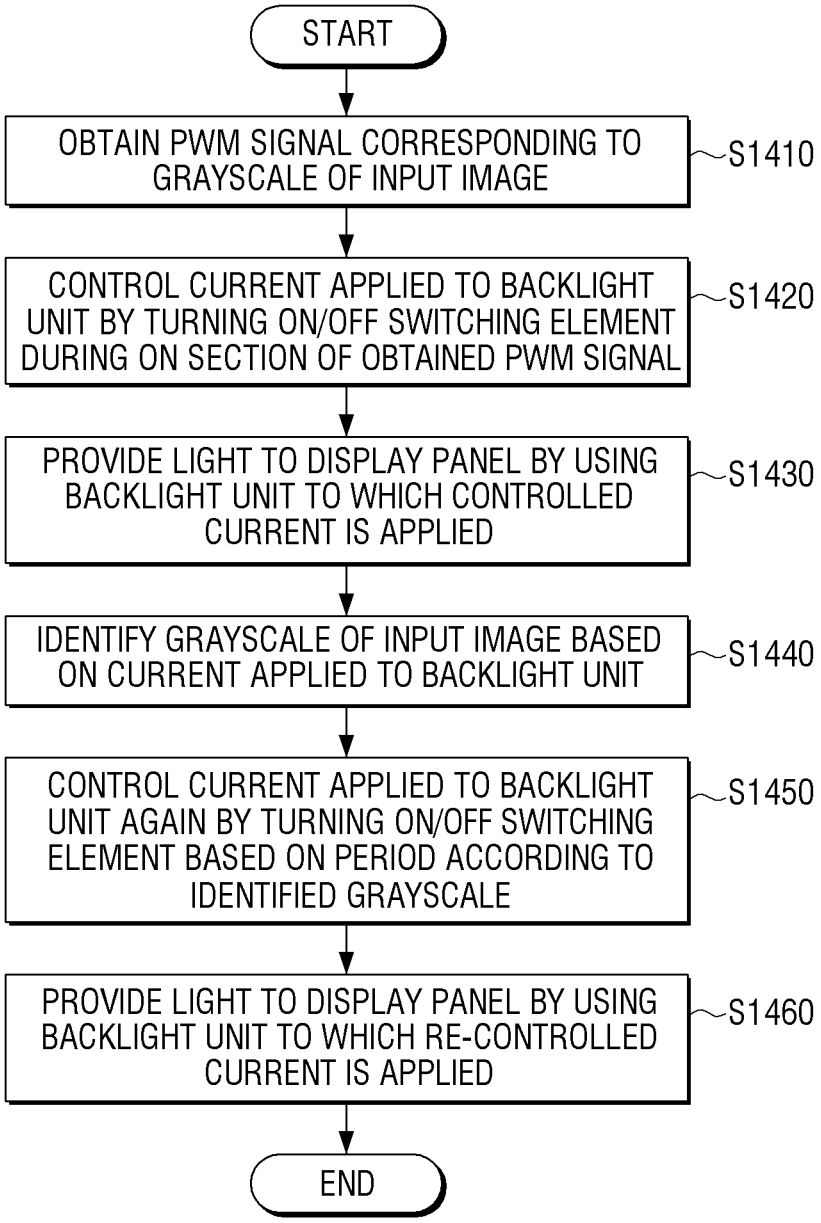
FIG. 14 is a sequence diagram illustrating a control method of a display apparatus which identifies a grayscale of an input image by measuring a current applied.

FIG. 14 is a sequence diagram illustrating a method for identifying a grayscale of an input image based on a current applied to a backlight unit according to an embodiment.

Referring to FIG. 14, the method may obtain a PWM signal corresponding to a grayscale of an input image (S1410), and may control a current applied to the backlight unit by turning on/off a switching element during a section in which the obtained PWM signal is in the on-state (S1420).

In this case, the method may variably control the on/off period of the switching element according to the grayscale of the input image, or may not variably control the on/off period.

The method may provide light to a display panel by using the backlight unit to which the controlled current is applied (S1430).

In this case, the method may identify a grayscale of the input image based on the current applied to the backlight unit (S1440).

Specifically, based on a result of measuring the current flowing in the backlight unit, the method may obtain an amount of current (a value obtained by integrating the measured current with respect to a time) flowing in the backlight unit in every period of the PWM signal, and may identify the grayscale of the input image based on the identified amount of current.

After that, the method may control a current applied to the backlight unit again by turning on/off the switching element based on a period according to the identified grayscale (S1450).

In this case, when the period according to the identified grayscale is different from the on/off period of the switching element before the current flowing in the backlight unit is measured, the current flowing in the backlight unit is changed as a result of controlling the current applied to the backlight unit again.

In addition, the method may provide light to the display panel by using the backlight unit to which the re-controlled current is applied (S1460).

If the current flowing the backlight unit is changed as a result of controlling the current again, luminance of the display panel may be changed even when the same input image is inputted.

The control methods of the display apparatus described above with reference to FIGS. 13 and 14 may be performed by using at least one of the signal processor 110, the driver 120, the backlight unit 130, and the display panel 140 of the display apparatus 100 explained and illustrated through FIGS. 4 to 12, but this should not be considered as limiting.

For example, the control method described in FIG. 13 and/or FIG. 14 may be performed by a system including at least one display apparatus and at least one electronic device.

Various embodiments described above may be implemented in a recording medium that can be read by a computer or a similar device using software, hardware, or a combination thereof.

According to hardware implementation, embodiments described in the present disclosure may be implemented by using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, and an electric unit for performing other functions.

In some cases, embodiments described in the present disclosure may be implemented by the processor 150 itself. According to software implementation, embodiments such as procedures and functions described in the detailed description may be implemented by using separate software modules. Each of the software modules may perform one or more functions and operations described in the detailed description.

Computer instructions for performing the processing operations in the display apparatus 100 according to various embodiments described above may be stored in a non-transitory computer-readable medium. The computer instructions stored in the non-transitory computer-readable medium may instruct a specific apparatus to perform the processing operations in the display apparatus 100 according to various embodiments described above when being executed by a processor of the specific apparatus.

The non-transitory computer-readable medium refers to a medium that stores data semi-permanently such as a register, a cache, and a memory, and is readable by an apparatus. Specifically, the non-transitory computer-readable medium may be a compact disc (CD), a digital versatile disk (DVD), a hard disk, a Blu-ray disk, a universal serial bus (USB), a memory card, and a ROM.

The display apparatus and the control method thereof according to embodimens may have an effect of precisely expressing a low-grayscale image according to a grayscale level by controlling the switching element included in the driver controlling driving of the backlight unit.

In addition, only when a PWM signal and a dimming signal corresponding to each grayscale satisfies a predetermined condition, the on/off period of the switching element may be reduced or the switching element may be variably controlled according to various conditions, such that a low-grayscale image can be precisely expressed according to each grayscale level, and an excessive heating problem of the display apparatus can be prevented.

While embodiments have been shown and described with reference to the drawings, it will be understood by those skilled in the art that various changes in form and details may be made therein without departing from the spirit and scope of the disclosure, the scope of which is by the appended claims and their equivalents.

What is claimed is:

1. A display apparatus comprising:

a display panel;

a backlight unit configured to provide light to the display panel;

a signal processor configured to obtain a pulse width modulation (PWM) signal corresponding to a grayscale of an input image; and a driver comprising a switching element, the driver being configured to control a current applied to the backlight unit by alternately turning the switching element on and off during a section in which the PWM signal provided from the signal processor is in an on-state, wherein the current applied to the backlight unit rises based on the switching element being on, and the current applied to the backlight unit falls based on the switching element being off, wherein the driver is further configured to:

based on the grayscale of the input image being less than or equal to a first threshold value, alternately turn the switching element on and off based on a first period during a section in which a PWM signal corresponding to the grayscale being less than or equal to the first threshold value is in the on-state, based on the grayscale of the input image being greater than or equal to a second threshold value which is greater than the first threshold value, alternately turn the switching element on and off based on a second period which is longer than the first period during a section in which a PWM signal corresponding to the grayscale being greater than or equal to the second threshold value is in the on-state, and based on the grayscale of the input image being greater than the first threshold value and being less than the second threshold value, alternately turn the switching element on and off based on a third period during a section in which a PWM signal corresponding to the grayscale being greater than the first threshold value and being less than the second threshold value is in the on-state, wherein the third period constantly increases from the first period to the second period as the grayscale of the input image increases from the first threshold value to the second threshold value, wherein a plurality of grayscales of the input image comprise a first grayscale and a second grayscale which are continuous among the plurality of grayscales of the input image, wherein the driver is further configured to, based on the first grayscale of the input image being less than the first threshold value, alternately turn the switching element on and off at least once, in a difference section between a first section in which a PWM signal corresponding to the first grayscale is in the on-state and a second section in which a PWM signal corresponding to the second grayscale is in the on-state, based on the first period, and wherein the second grayscale is lower than the first grayscale.

2. The display apparatus of claim 1, wherein the driver is further configured to, based on a duty cycle of the PWM signal being greater than or equal to a value, alternately turn the switching element on and off based on the third period, and, based on the duty cycle of the PWM signal being less than the value, alternately turn the switching element on and off based on the first period.

3. The display apparatus of claim 1, wherein the signal processor is further configured to obtain a dimming signal corresponding to the grayscale of the input image, and wherein the driver is further configured to, based on a size of the dimming signal provided from the signal processor being greater than or equal to a value, alternately turn the switching element on and off based on the third period, and, based on the size of the dimming signal being less than the value, alternately turn the switching element on and off based on the first period.

4. The display apparatus of claim 1, wherein the driver is further configured to identify the grayscale of the input image based on the current applied to the backlight unit, and to alternately turn the switching element on and off based on a period according to the identified grayscale.

5. The display apparatus of claim 1, further comprising a variable inductor connected with the backlight unit, wherein the driver is further configured to, based on the grayscale of the input image being greater than or equal to a threshold value, set an inductance of the variable inductor to a first value, and, based on the grayscale of the input image being less than the threshold value, to set the inductance of the variable inductor to a second value which is smaller than the first value.

6. The display apparatus of claim 1, wherein the driver is further configure;

based on the grayscale of the input image gradually decreasing and being lower than the first threshold value, alternately turn the switching element on and off based on the first period; and based on the grayscale of the input image gradually increasing and being higher than the second threshold value, alternately turn the switching element on and off based on the second period which is longer than the first period, and wherein the first threshold value is smaller than the second threshold value.

7. A control method of a display apparatus, the control method comprising:

obtaining a pulse width modulation (PWM) signal corresponding to a grayscale of an input image;

controlling a current applied to a backlight unit by alternately turning a switching element on and off during a section in which the obtained PWM signal is in an on-state, wherein the current applied to the backlight unit rises based on the switching element being on, and the current applied to the backlight unit falls based on the switching element being off;

providing light to a display panel by using the backlight unit; and wherein the controlling the current comprises:

based on the grayscale of the input image being less than or equal to a first threshold value, alternately turning the switching element on and off based on a first period during a section in which a PWM signal corresponding to the grayscale being less than or equal to the first threshold value is in the on-state, based on the grayscale of the input image being greater than or equal to a second threshold value which is greater than the first threshold value, alternately turn the switching element on and off based on a second period which is longer than the first period during a section in which a PWM signal corresponding to the grayscale being greater than or equal to the second threshold value is in the on-state, and based on the grayscale of the input image greater than the first threshold value and being less than the second threshold value, alternately turning the switching element on and off based on a third period during a section in which a PWM signal corresponding to the grayscale being greater than the first threshold value and being less than the second threshold value is in the on-state, wherein the third period constantly increases from the first period to the second period as the grayscale of the input image increases from the first threshold value to the second threshold value, wherein a plurality of grayscales of the input image comprise a first grayscale and a second grayscale which are continuous among the plurality of grayscales of the input image, wherein the controlling the current comprises, based on the first grayscale of the input image being less than the first threshold value, alternately turning the switching element on and off at least once, in a difference section between a first section in which a PWM signal corresponding to the first grayscale is in the on-state and a second section in which a PWM signal corresponding to the second grayscale is in the on-state, based on the first period, and wherein the second grayscale is lower than the first grayscale.

8. The control method of claim 7, wherein the controlling the current further comprises, based on a duty of the PWM signal being greater than or equal to a value, alternately turning the switching element on and off based on the third period, and, based on the duty of the PWM signal being less than the value, alternately turning the switching element on and off based on the first period.

9. The control method of claim 7, further comprising obtaining a dimming signal corresponding to the grayscale of the input image, and wherein the controlling the current further comprises, based on a size of the dimming signal being greater than or equal to a value, alternately turning the switching element on and off based on the third period, and, based on the size of the dimming signal being less than the value, alternately turning the switching element on and off based on the first period.

10. The control method of claim 7, further comprising identifying the grayscale of the input image based on the current applied to the backlight unit, and wherein the controlling the current further comprises alternately turning the switching element on and off based on a period according to the identified grayscale.

11. The control method of claim 7, further comprising setting an inductance of a variable inductor connected with the backlight unit, wherein the setting the inductance comprises, based on the grayscale of the input image being greater than or equal to a threshold value, setting the inductance of the variable inductor to a first value, and, based on the grayscale of the input image being less than the threshold value, setting the inductance of the variable inductor to a second value which is smaller than the first value.

12. The control method of claim 7, wherein the controlling the current further comprises:

based on the grayscale of the input image gradually decreasing and being lower than the first threshold value, alternately turning the switching element on and off based on the first period; and based on the grayscale of the input image gradually increasing and being higher than the second threshold value, alternately turning the switching element on and off based on the second period which is longer than the first period, and wherein the first threshold value is smaller than the second threshold value.

* * * * *